US007779997B2

(12) United States Patent
Cuomo

(10) Patent No.: US 7,779,997 B2
(45) Date of Patent: Aug. 24, 2010

(54) CARRIER AND METHOD

(75) Inventor: Angelo V. Cuomo, Staten Island, NY (US)

(73) Assignee: SJV Food & Beverage Carriers, Inc., Clark, NJ (US)

( * ) Notice: Subject to any disclaimer, the term of this patent is extended or adjusted under 35 U.S.C. 154(b) by 517 days.

(21) Appl. No.: 11/804,147

(22) Filed: May 16, 2007

(65) Prior Publication Data

US 2007/0246376 A1 Oct. 25, 2007

Related U.S. Application Data

(63) Continuation-in-part of application No. 10/737,612, filed on Dec. 16, 2003, now Pat. No. 7,267,224, and a continuation-in-part of application No. 10/939,264, filed on Sep. 10, 2004, now Pat. No. 7,604,115.

(51) Int. Cl.
*B65D 75/00* (2006.01)

(52) U.S. Cl. ..... 206/174; 206/162; 206/170; 206/180; 206/193; 229/117; 229/117.14

(58) Field of Classification Search ..... 206/139, 206/143, 173, 162, 175, 147, 174, 194, 199, 206/193, 185, 180, 427; 229/117, 117.03, 229/117.04, 178, 117.14, 117.12, 183, 164
See application file for complete search history.

(56) References Cited

U.S. PATENT DOCUMENTS

| | | | | |
|---|---|---|---|---|
| 952,302 | A | | 3/1910 | Brenner |
| 962,607 | A | | 6/1910 | Wood |
| 982,919 | A | | 1/1911 | Wood |
| 1,223,202 | A | | 4/1917 | Proctor |
| 2,026,525 | A | | 6/1936 | Korte |
| 2,011,232 | A | | 8/1936 | Parks |
| 2,319,380 | A | | 4/1939 | Wells |
| 2,284,290 | A | | 2/1941 | Marshall, Jr. |
| 2,339,176 | A | | 4/1941 | Lee |
| 2,373,851 | A | | 4/1945 | Potter |
| 2,405,517 | A | | 8/1946 | Plummer |
| 2,630,264 | A | | 4/1949 | Holy |
| 2,513,079 | A | | 6/1950 | Buerger |
| 2,594,376 | A | | 4/1952 | Ameson |
| 2,702,154 | A | * | 2/1955 | Linson ..... 229/114 |
| 2,828,047 | A | | 3/1958 | Weiselberg |
| 2,850,223 | A | | 9/1958 | Staruss |
| 3,158,286 | A | | 11/1964 | Phillips, Jr. |
| 3,266,663 | A | | 8/1966 | Ringler |
| 3,547,339 | A | | 12/1970 | Bruce |
| 3,576,274 | A | | 4/1971 | Stramaglia |
| 3,780,906 | A | | 12/1973 | Katzenmeyer |
| 4,047,610 | A | | 9/1977 | Stout et al. |
| 4,089,457 | A | | 5/1978 | Wood et al. |
| 4,126,266 | A | * | 11/1978 | Roccaforte ..... 294/55 |

(Continued)

*Primary Examiner*—David T Fidei
(74) *Attorney, Agent, or Firm*—Gregor N. Neff

(57) ABSTRACT

The carrier has a central vertical support panel structure, and a pair of foldable receptacles extending outwardly from opposite sides of the vertical support structure. The receptacles have automatically-opening bottom walls with symmetrical bottom panels which overlap to even-out the strength of the bottom walls and minimize areas of reduced strength. At least two opposed bottom panels are shaped to interlock with one another to hold the carrier open once it has been unfolded. Elongated, connected reinforcing flanges strengthen the carrier in the vertical direction.

11 Claims, 2 Drawing Sheets

U.S. PATENT DOCUMENTS

| | | | |
|---|---|---|---|
| 4,378,880 | A | 4/1983 | Summers |
| 4,610,349 | A | 9/1986 | Schwartz et al. |
| 4,767,051 | A | 8/1988 | Single |
| 4,770,294 | A | 9/1988 | Graser |
| 4,798,285 | A | 1/1989 | Hernandez |
| 4,836,367 | A | 6/1989 | Golkar |
| 5,052,552 | A | 10/1991 | Maroszek |
| 5,415,277 | A | 5/1995 | Bernstein |
| 5,423,420 | A | 6/1995 | Bakx |
| D367,409 | S | 2/1996 | Hunter |
| 5,501,338 | A | 3/1996 | Preston |
| 5,524,814 | A | 6/1996 | Davis |
| 5,609,379 | A | 3/1997 | Harrelson |
| 5,611,425 | A | 3/1997 | Holley, Jr. |
| 5,624,024 | A | 4/1997 | Miess |
| 5,645,162 | A | 7/1997 | Harrelson |
| 5,695,051 | A | 12/1997 | Hart |
| 5,709,298 | A | 1/1998 | Harris |
| 5,738,217 | A | 4/1998 | Hunter |
| 5,765,648 | A | 6/1998 | Sheehan et al. |
| 5,788,081 | A | 8/1998 | Bates |
| 5,797,486 | A | 8/1998 | Picciolo |
| 5,803,264 | A | 9/1998 | Gersten et al. |
| 5,813,540 | A | 9/1998 | Vollbrecht et al. |
| 5,816,405 | A | 10/1998 | Carriger, Jr. |
| 5,833,056 | A | 11/1998 | Goldman |
| 5,884,756 | A | 3/1999 | Holley, Jr. et al. |
| 5,927,502 | A | 7/1999 | Hunter |
| 5,927,593 | A | 7/1999 | Berkowitz et al. |
| 5,957,276 | A | 9/1999 | Cutler et al. |
| 5,975,287 | A | 11/1999 | Negelen |
| 6,000,536 | A | 12/1999 | Piotrowski |
| 6,168,013 | B1 | 1/2001 | Gomes |
| 6,202,836 | B1 | 3/2001 | Picciolo |
| 6,230,881 | B1 | 5/2001 | Collurs |
| 6,341,689 | B1 | 1/2002 | Jones |
| 6,443,308 | B1 | 9/2002 | Davis |
| 6,598,739 | B1 | 7/2003 | Collura |
| 2002/0179459 | A1 | 12/2002 | Bakx |
| 2003/0213705 | A1 | 11/2003 | Woog |

* cited by examiner

CARRIER AND METHOD

This application is a continuation-in-part of U.S. patent application Ser. No. 10/737,612, filed Dec. 16, 2003 now U.S. Pat. No. 7,267,224 and of Ser. No. 10/939,264, filed Sep. 10, 2004 now U.S. Pat. No 7,604,115. The disclosures of those patent applications are incorporated herein by reference.

The carriers described in the above-identified pending U.S. applications are superior in many respects to other carriers used or proposed in the past. They can support relatively large loads, they have relatively large areas available on which to place advertising, they have bottom walls which open automatically when the side edges of the folded carrier are pressed together, and they have means for holding the carrier in its open, unfolded condition automatically, without using the hand or a machine element.

Furthermore, the carriers are economical to manufacture, requiring less material than many prior carriers, and, when folded, occupy less surface area than many prior carriers so as to minimize packaging size and shipping costs when the carriers are shipped in folded form.

Despite the superior features of the foregoing carriers, it is an object of this invention to provide a carrier, a method of manufacturing the carrier, and a blank from which to fabricate the carrier which has improved strength, ease of fabrication and use, and is possible to manufacture even more economically.

In accordance with the present invention, the foregoing objects are satisfied by provided a carrier with a central support structure comprising at least one vertical support panel, a pair of foldable receptacles extending outwardly from opposite sides of the central support structure when the carrier is unfolded, and an automatically opening bottom wall in each of the receptacles.

Each bottom wall preferably includes flanges extending from the lower edge of each of four side-walls for each of the receptacles, with two opposed flanges, being shaped to interlock with the other panel to hold the carrier open after it has been unfolded.

Preferably, each of the two flanges has a lateral edge which engages a lateral edge on the other during the unfolding of the bottom structure whereby the two lateral edges engage one another to hold the carrier open.

Preferably, each of the two interlocking flanges is, at its widest, substantially as wide as the bottom in each receptacle, so that the wide part of each flange extends substantially up to the opposite side-wall, thus providing increased strength for the bottom wall.

Preferably, the two flanges are symmetrical with respect to one another to give the bottom of more nearly uniform strength over the entire surface of the bottom wall.

It is also preferable that each of the two flanges has at least one tab extending from an outer edge thereof, which fits into a slot in the lower portion of a side-wall when the flange is completely recessed, thereby further locking the panels to the side-wall structure.

Preferably, the vertical support panels are secured together, and a handle structure is formed in the panels to provide a hand-hold for carrying the carrier.

Also, the two flanges are of complementary shape; that is, one is wide where the other is narrow, etc.

In another aspect, the invention resides in a bottom wall structure for a carrier, in which two opposed bottom flanges, shaped to interlock with one another, are connected to other bottom flanges which pull the two panels together top interlock them and hold the carrier open when it is unfolded.

Preferably, the opposed flanges are of complementary shape, overlap one another and form an upper surface for the bottom wall in which the strength is distributed over the surface of the bottom wall.

Also preferably, the bottom wall structure includes two other flanges which are interconnected with one another so that the bottom wall structures unfold automatically when the carrier is unfolded, and the carrier can be fully opened by a single opening movement.

Also in accordance with the invention, a blank is provided for use in fabricating the carrier from a single piece of sheet material. Preferably, the blank has a pair of vertical support panels hinged together along a fold line at the top edge, with three serially-connected receptacle wall sections connected at one edge of each vertical support panel. Extending from the outermost edge of the last panel in the series is an elongated attachment flange which is approximately as long as the vertical support panels. The attachment flanges are connected together at one end along a fold line.

When the carrier is fabricated, preferably, the wall sections are folded relative to one another along fold lines parallel to the vertical edges of the support panels, and the elongated attachment flanges are secured to the panels along edges to reinforce the panels and provide improved vertical lift strength for the carrier.

The vertical support panels either can be hinged together along a fold line at the upper edges of the panels, so the panels can be swung apart, or the panels can be glued together back-to-back.

The invention also contemplates the provision of a carrier using such elongated attachment flanges for connecting the vertical support panels together, as well as reinforcing them.

The foregoing and other objects and advantages of the invention will be set forth in or apparent from the following description and drawings.

IN THE DRAWINGS

GENERAL DESCRIPTION

Figure 1:
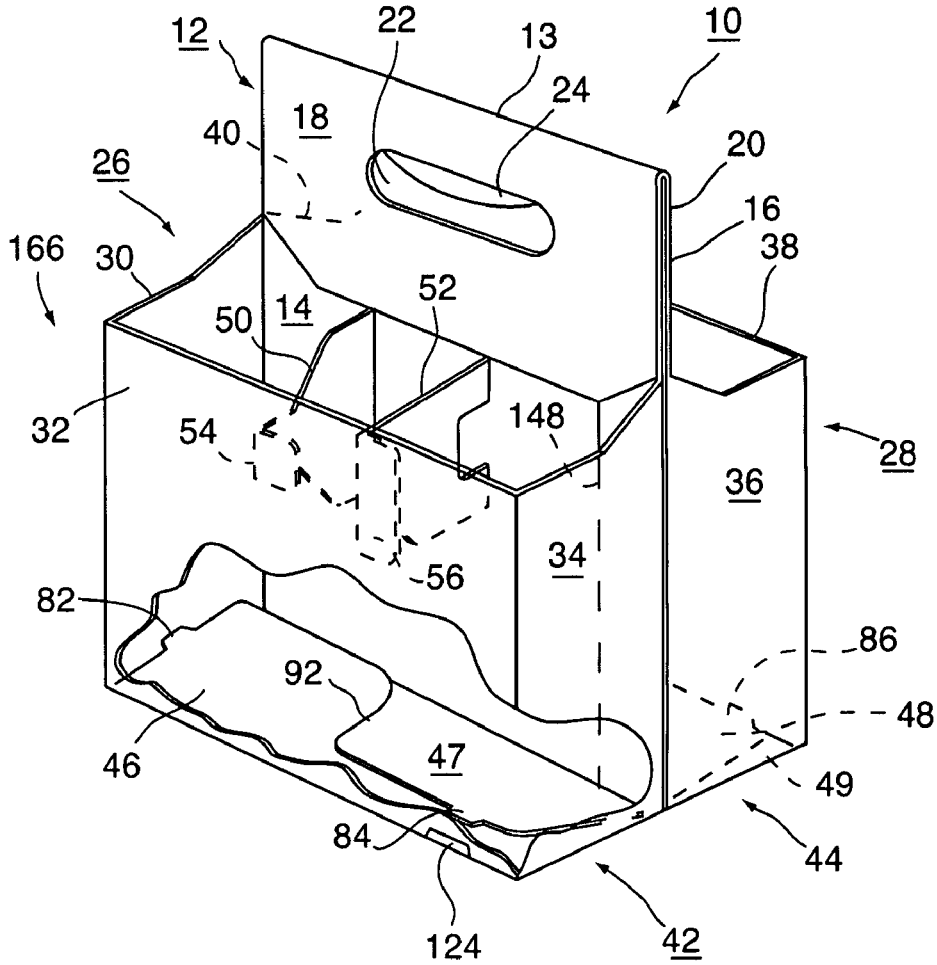
FIG. 1 is a perspective view, partially broken-away, of a carrier constructed in accordance with the present invention.
Figure 2:
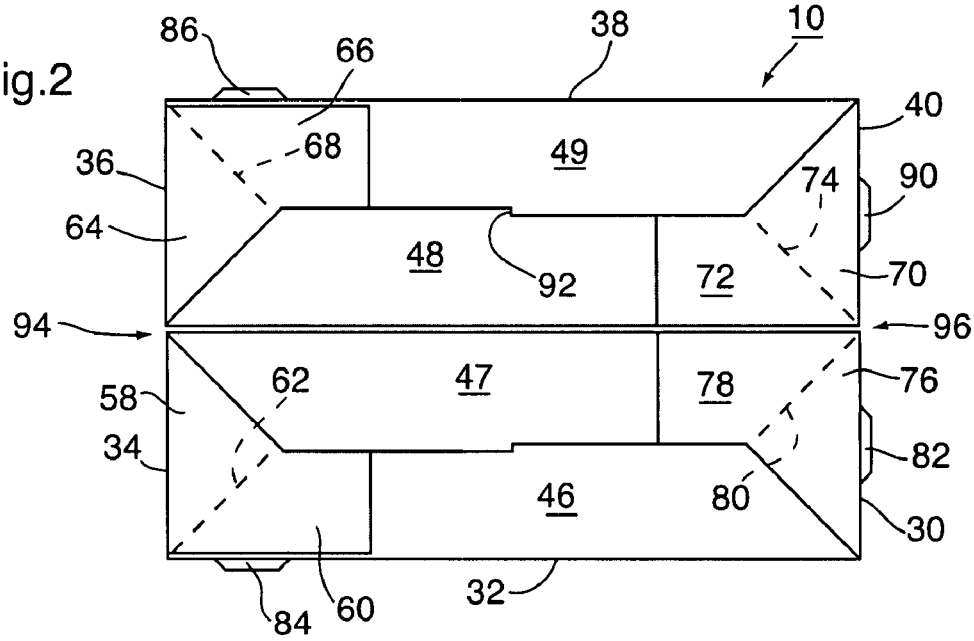
FIG. 2 is a bottom plan view of the carrier shown in FIG. 1.

The carrier 10 shown in FIGS. 1 and 2 includes a central support structure 12 comprising two vertical support panels 14 and 16 adhered together back-to-back, or, alternatively, hinged together along their top edges 13. Reinforcement panels 18 and 20 are glued to the upper portions of the support panels 14 and 16. A handle hole 22 with a guard member 24 is located in the center of each of the upper portions of the panels 14 and 16 to form a handle structure for lifting and carrying the carrier and its contents.

A pair of foldable receptacles 26 and 28 extend outwardly from opposite sides of the central support structure 12. Each receptacle has four walls, one of which is formed by one of the vertical support panels 14 or 16. The receptacle 26 has a series of side-wall panels 30, 32, and 34 connected together along fold lines and extending outwardly from the panel 14 when the carrier is unfolded. Similarly, receptacle 28 has a series of side-wall panels 36, 38, and 40 extending outwardly from the panel 16.

Each of the receptacles has a bottom wall structure 42 or 44 which opens automatically when the folded-up carrier is pressed together at the sides in the directions of the arrows 94 and 96 shown in FIG. 2 so as to quickly open and prepare the carrier for receiving objects to be carried.

The carrier is shown in FIG. 1 in the position it takes after the single motion pushing the edges of the folded blank together. The bottom wall structure 42 or 44 is only partially unfolded.

Each of the bottom wall structures 42 and 44 includes four flanges, each secured to the lower edge of one of the four side-walls of each of the two receptacles 26 and 28.

Bottom Structure

It is particularly advantageous that two opposed ones of those flanges, such as the uppermost flanges 46 and 47 are recessed in one section and are shaped to overlap and interlock with one another so as to hold the carrier in the unfolded condition shown in FIG. 1 without the use of one's hands or mechanisms.

The recesses are in opposite sections so that the flanges overlap one another and each has a lateral edge. The lateral edges are positioned so that they engage with one another such as at the location 92 shown in FIG. 1 when the flanges 46 and 47 are interlocked. This prevents the fiberboard material of which the carrier is made from folding up and thus returning to its folded condition. This holds the receptacles open to allow beverage bottles or other objects to be loaded into the carrier and press the bottom panels downwardly to flatten them.

Preferably, the flanges are symmetrical with respect to one another, with respect to a longitudinal center line 5 and a transverse center line 53 of each bottom wall. This helps to even-out the bottom strength and minimize weak spots.

The bottom wall structures 42 and 44 are shown in FIG. 1 with the bottom panels, such as 46, 47, in an intermediate position to which they are automatically pulled by the interconnection of the bottom flanges unfold the bottom wall structures automatically. Thus, the panels 46 and 47 are shown in positions above their lower-most positions which they will attain when a beverage bottle is deposited on top of the panels.

Dividers 50 and 52 (as well as dividers for the other receptacle 28, which are not shown in FIG. 1), are provided to divide each receptacle into three compartments so that each receptacle holds three bottles or other containers. Each of the dividers 50, 52 has a glue tab 54 or 56 which is glued to the surface of the panel 32 or 38 opposite the central support structure.

The carrier 10 shown in FIGS. 1 and 2 is particularly well suited for use as a six-pack carrier for beverage containers such as bottles, etc., and is highly advantageous for use in bottling plants where the carriers are filled with beverages to be shipped to stores for sale.

Carrier Blank

Figure 3:
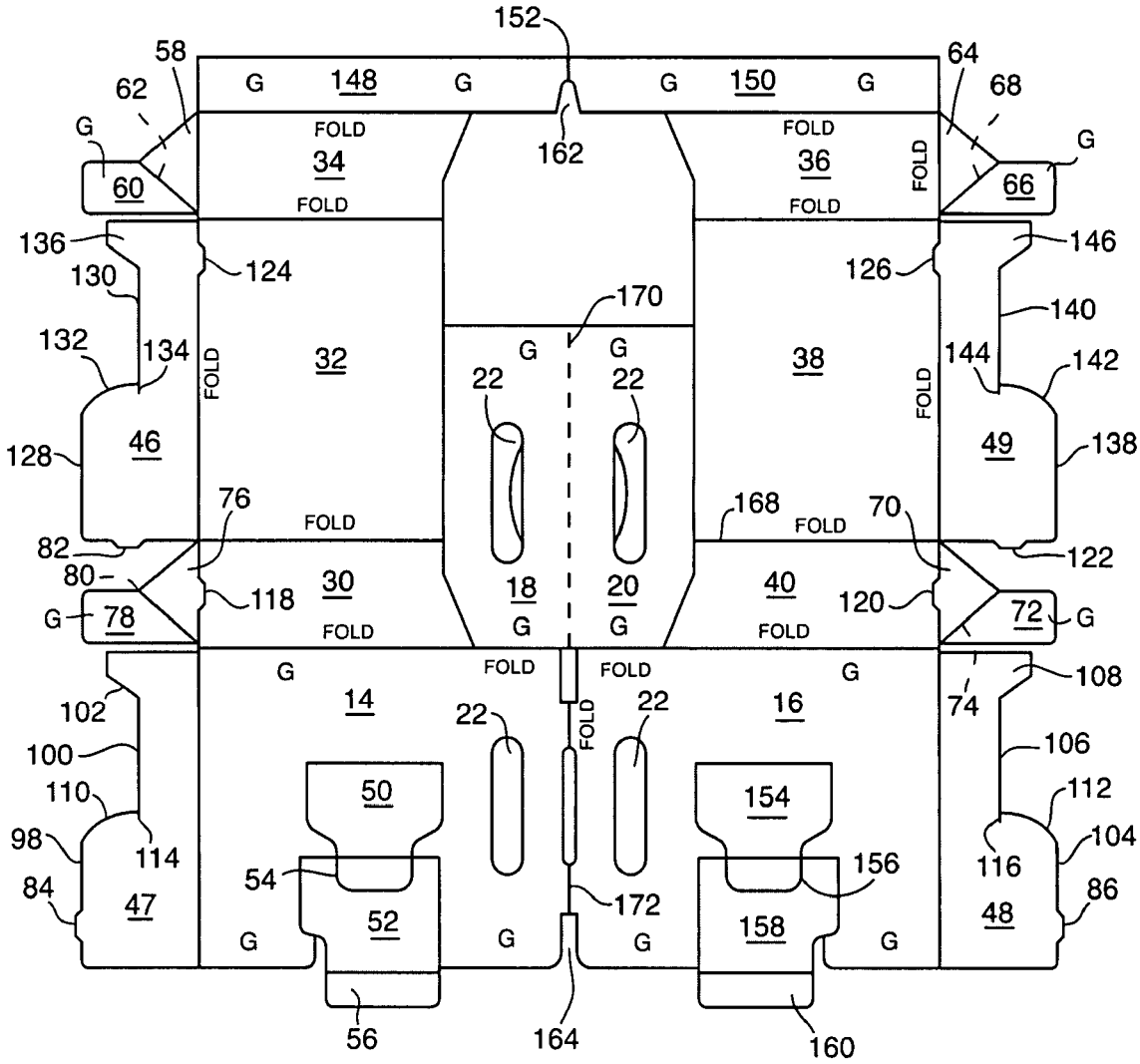
FIG. 3 is a top plan view of a blank used to fabricate the carrier shown in FIGS. 1 and 2.

Now referring to FIG. 3, as well as to FIGS. 1 and 2, each of the four recessed flanges 46, 47, 48, and 49 has a tab extending outwardly from one edge. The flanges 46 and 49 have a tab 82 or 122 extending from the short side edge of the flange.

The flanges 47 and 48 have tabs 84 and 86, respectively, extending out of a longer side edge.

As it can be seen in FIG. 1, as well as FIG. 3, the tab 84 in the flange 47 fits into a slot 124 in the panel 32 near the bottom edge of the panel, and the tab 82 fits into a slot 118 in the bottom edge of the panel 30 when the panel 46 is pressed to its lower-most position. Thus, the tabs on the flanges 46, 47, 48, and 49 fit into slots in the side-walls which hold those panels downwardly when beverage containers or other objects are loaded into the carrier and depress the panels downwardly. This helps hold the bottom wall down solidly and minimize the chance that the carrier will accidentally close after being opened.

Interlocking Flanges

As it is shown best in FIG. 3, each of the bottom flanges 46-49 has an outermost edge 98, 128, 104, or 138, and an inner recessed edge 100, 130, 140, or 106. The corner of the recess is rounded, and the recess forms a lateral edge 110, 132, 142, or 112. At the opposite end of each flange a truncated triangular extension 102, 136, 146, or 108 is provided for extra strength.

Extending from the lower edge of each of the shorter side-wall panels 30, 34, 36, and 40 is a triangular flange 76, 58, 64, or 70 with an attached glue tab 78, 60, 66, or 72 secured to the first flange along a fold line 80, 62, 68, or 74.

As it is shown in FIG. 2, the glue tabs 60, 66, 72, and 78 are glued, respectively, to the flanges 49, 46, 47, and 48. Advantageously, the glue tab is elongated, preferably to equal the width of the widest portion of each of the flanges 46-49 so as to extend as far as possible along the flange to which it is attached, thereby strengthening the bottom structure of each receptacle, without using excess material.

Optionally, a slit 134, 114, 144, o4 116 can be provided at the junction between the lateral edge and the inner edge of each of the four flanges 46-49 to provide for more positive locking engagement between the edges of adjacent panels.

As it is shown in FIG. 3, dividers 154 and 158 with glue tabs 156 and 160 are provided for the receptacle 28 but are not shown in either of FIGS. 1 and 2. Each of the dividers 50 and 154 is "nested" with another divider 52 or 158 to save materials.

In FIG. 3, fold lines are indicated with the letter "F", and areas to be glued, in one embodiment of the carrier, are marked with the letter "G".

In accordance with another feature of the present invention, elongated attachment flanges 148 and 150 are secured to the outermost edge of the panels 34 and 36, respectively. The flanges 148 and 150 are attached together along the fold line 152, with a notch 162 being cut in the material adjacent the fold line 152 to match with the notch 164 at the upper edges of the vertical support panels.

Since the flanges 148 and 150 are relatively wide, and are approximately as tall as the vertical support panels, and are secured together at 152, they provide exceptional reinforcement of the edges of the vertical support panels, as well as secure anchors for the ends of the side-wall panel series forming the side-walls of the carriers. This further increase the load carrying capability of the carrier.

The bottom construction of the carrier 10 is very advantageous. Because the flanges 46, 47, and 48, 49 overlap one another, are symmetrical and extend completely across the bottom wall of each receptacle, the strengthening added by the flanges is well distributed over the bottom wall so as to minimize any points of weakness in the bottom wall.

Furthermore, when the bottom panels 46, 47 and 48, 49 lock together edge-to-edge, this creates an extremely stable structure to hold the carrier open and prevent it from relapsing in the direction of the arrow 166 in FIG. 1 to fold up again due to the natural resilience of the fiberboard material.

The tabs on the bottom panels and the slots near the bottom edges of the side-walls of the receptacles help in holding the bottom panels down and preventing the bottom from unfolding.

It should be understood that additional or differently placed tabs and slots can be provided as desired instead of, or in addition to, the tabs and slots shown in the drawings.

It should be understood that the carrier construction described herein, with minor modifications, can be used highly advantageously for carrying out food from a vending establishment, such as a concession stand in a sports arena, a fast food restaurant, etc. Carriers specially adapted for such use are shown in my above-identified co-pending patent applications, and it is unnecessary to describe them in detail here. However, in general, the modifications usually would be to enlarge the compartments receiving the beverage containers to receive large cups, reduce the number of compartments, increase the height of the vertical support panels, and supply top trays with slots in the bottom to receive the vertical support panels, to enable the carrying of solid foods in the top trays, using only one hand to carry everything.

As it is noted above, the vertical support panels 14, 16 can be secured together back-to-back with glue, as indicated by the "G" markings in FIG. 3. Alternatively, the vertical support panels 14 and 16 and their reinforcing panels 18, 20 can be secured together only along fold lines 172, 170 so that the inside walls of the panels 14, 16 can bear advertising, promotional materials, etc., which the customer can access by simply swinging the two receptacles apart. This is a type of carrier sometimes referred to as a "saddlebag" carrier.

If the saddlebag type of construction is selected, the flange 148 is glued to the back side of panel 14, and the flange 15 is glued to the back side of panel 16. The flanges 150, 148, remain attached at the fold line 152.

The above description of the invention is intended to be illustrative and not limiting. Various changes or modifications in the embodiments described may occur to those skilled in the art. These can be made without departing from the spirit or scope of the invention.

What is claimed is:

1. A carrier comprising a central support structure including two vertical support panels, each having a lower portion and an upper portion with a handle structure, a pair of foldable receptacles, each extending outwardly from said lower portion of one of said vertical support panels on opposite sides of said central support structure when said carrier is unfolded, each of said receptacles having four side-walls, with one of said side-walls being formed by a portion of said central support structure, said upper portions of said vertical support panels extending a substantial distance above said receptacles, a bottom wall structure for each of said receptacles, said bottom wall structure comprising a flange extending outwardly from the lower edge of each of said four side-walls and being secured thereto along a fold line, one of said side-walls being parallel to but spaced from said central support structure, said flanges being interconnected with one another so as to fold flat inside of said four walls of said receptacle, and unfold automatically when said side-walls are spread apart to unfold said carrier, and at least one automatically unfolding divider member in each of said receptacles, said divider member extending from one of said vertical support panels and being secured between said one side-wall and said one vertical support panel, said divider member being shaped and positioned so as to enable the unfolding of said flanges during unfolding of said carrier.

2. A carrier as in claim 1 including a first one of said flanges extending from said one side-wall and a second one extending from said central support structure, each of said first and second flanges having an outer edge and a recess, said first and second flanges being shaped to interlock with one another when said carrier is unfolded, in which each of said recesses forms a lateral edge transverse to said outer edge, said recesses being formed in opposite portions of said flanges, with said lateral edges being located to engage one another when aid carrier is unfolded.

3. A carrier as in claim 1 in which each of said divider members is located at a distance above said bottom wall structure of the receptacle in which said divider member is located to ensure clearance between said divider members and said flanges of said bottom wall when said carrier is being unfolded.

4. A carrier as in claim 1 including a pair of reinforcing panels formed from the same sheet of material as said vertical support panels, each being folded over onto and secured to said upper portion of one of said vertical support panels.

5. A carrier as in claim 1 in which the four flanges of each of said bottom structures includes first, second, third and fourth ones of said flanges, and each of said third and fourth flanges has a base flange area with an enlongated tab secured thereto along a diagonal fold line, with said diagonal fold lines being located at opposite corners of the bottom structure, with each of said enlongated tabs being secured to one of said first and second flanges.

6. A carrier as in claim 5 in which each of said enlongated tabs extends outwardly to approximately the same length as the width of said bottom wall structure, and said base flange area has approximately the same width as the width of the side wall portion to which it is secured.

7. A carrier as in claim 2 in which each of said outer edges has a substantially curved corner at the beginning of said recess to ease the passage of said corners over one another during unfolding of said carrier.

8. A carrier comprising a central support structure including two vertical support panels, each having a lower portion and an upper portion with a handle structure in said upper portion, a pair of foldable receptacles, each extending outwardly from said lower portion of one of said vertical support panels on opposite sides of said central support structure when said carrier is unfolded, each of said receptacles having four side-walls, one of said side-walls being formed by a portion of said central support structure, a bottom wall structure for each of said receptacles, said bottom wall structure comprising first, second, third and fourth flanges, each extending outwardly from the lower edge of one of said four side-walls and being secured thereto along a fold line, one of said side-walls being parallel to but spaced from said central support structure, said flanges being interconnected with one another so as to fold flat inside of said four walls of said receptacle, and unfold automatically when said side-walls are spread apart to unfold said carrier, said first of said flanges extending from said central support structure and said second of said flanges from said one side-wall, each of said first and second flanges being shaped to interlock with one another when said carrier is unfolded, in which each of said first and second flanges has a portion which extends to adjacent the side-wall opposite the wall to which the flange is secured and overlaps the other one of said first and second flanges, and a pair of reinforcing panels, said vertical support panels and said reinforcing panels being made from a single sheet of material, with each of said reinforcing panels being secured to one of said vertical support panels along a fold line, and being folded over onto and secured to one of said vertical support panels.

9. A carrier as in claim 8, a first one of said flanges extending from said one side-wall and a second one extending from said central support structure, each of said first and second flanges having an outer edge and a recess, said first and second flanges being shaped to interlock with one another when said carrier is unfolded, in which each of said recesses forms a lateral edge transverse to said outer edge, said recesses being formed in opposite portions of said flanges, with said lateral edges being located to engage one another when aid carrier is unfolded.

10. A carrier as in claim 9 in which each of said divider members is located at a distance above said bottom wall structure of the receptacle in which said divider member is located to ensure clearance between said divider members and said flanges of said bottom wall when said carrier is being unfolded.

11. A blank for making a foldable carrier, said blank comprising a single sheet of material forming:

a pair of vertical support panels, each having an upper and a lower portion, a pair of side-wall structures each comprising a series of side-wall panels, each being secured to one another, each side-walls structure being secured to a side edge of one of said vertical support panels in said lower portion of said vertical support panel, a bottom flange extending from the bottom edge of each of said side-wall panels and said vertical support structures, said bottom flanges being formed so as to enable them to be secured together in an automatically-opening, inwardly folding bottom structure for each of said sidewall structures, a side-wall securing flange extending outwardly from a side edge of an end panel in each of said series of side-wall panels, and including at least one divider cut out of each of said vertical support panels at a location vertically spaced above said bottom flanges sufficiently to ensure clearance of said bottom flanges while unfolding, said divider extending through one side edge of said vertical support panel, said side-wall securing flange being securable to cover said one side edge.

* * * * *